US008657580B2

(12) United States Patent
Xiao et al.

(10) Patent No.: US 8,657,580 B2
(45) Date of Patent: Feb. 25, 2014

(54) BLADE RETAINMENT SYSTEM

(75) Inventors: Xinwen Xiao, San Diego, CA (US); Venkata S. Bandaru, Manchester, CT (US); Shiv C. Gupta, San Diego, CA (US); Gordon F. Jewess, San Diego, CA (US)

(73) Assignee: Pratt & Whitney, East Hartford, CT (US)

( * ) Notice: Subject to any disclaimer, the term of this patent is extended or adjusted under 35 U.S.C. 154(b) by 708 days.

(21) Appl. No.: 12/818,081

(22) Filed: Jun. 17, 2010

(65) Prior Publication Data

US 2011/0311358 A1 Dec. 22, 2011

(51) Int. Cl.
*B64C 11/04* (2006.01)
*F03B 3/12* (2006.01)
*F04D 29/34* (2006.01)

(52) U.S. Cl.
USPC ..... 416/220 R

(58) Field of Classification Search
USPC ..... 416/220 R, 204 A, 248
See application file for complete search history.

(56) References Cited

U.S. PATENT DOCUMENTS

| | | | | |
|---|---|---|---|---|
| 4,395,827 | A | 8/1983 | Stowe et al. | |
| 4,480,959 | A | 11/1984 | Bourguignon et al. | |
| 5,052,893 | A * | 10/1991 | Catte | 416/220 R |
| 5,435,694 | A * | 7/1995 | Kray et al. | 416/219 R |
| 6,317,048 | B1 | 11/2001 | Bomya | |
| 6,416,286 | B1 * | 7/2002 | Roberts et al. | 416/191 |
| 7,216,694 | B2 * | 5/2007 | Otero et al. | 164/516 |
| 8,066,096 | B1 | 11/2011 | Francisco | |
| 8,206,259 | B2 | 6/2012 | Lang | |
| 8,299,883 | B2 | 10/2012 | Katsumata | |
| 8,357,070 | B2 | 1/2013 | Duong | |
| 2008/0286106 | A1 | 11/2008 | Keith et al. | |
| 2009/0053064 | A1 | 2/2009 | Ress, Jr. | |
| 2009/0060746 | A1 | 3/2009 | Barr, Jr. et al. | |

* cited by examiner

*Primary Examiner* — Edward Look
*Assistant Examiner* — Christopher J Hargitt
(74) *Attorney, Agent, or Firm* — Stephen G. Mican

(57) ABSTRACT

A blade retention system for retaining a foot of a turbine blade in a shoe of a turbine disc of a turbine wheel includes: a hook on a heel end of the blade foot that protrudes from a bottom of the blade foot to engage a heel end of the turbine disc shoe; and a compound fillet that engages the hook with the bottom of the blade foot.

19 Claims, 5 Drawing Sheets

BLADE RETAINMENT SYSTEM

Figure 2:
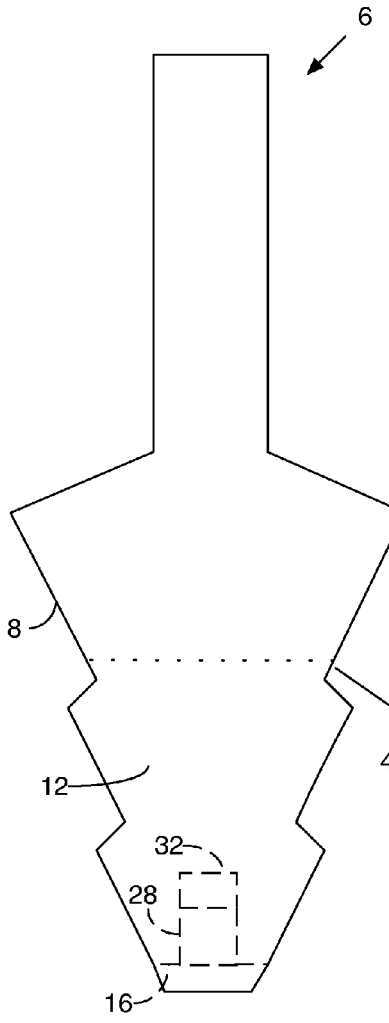
FIGS. 2 and 3 are end and side views of a turbine blade for the turbine wheel of FIG. 1.
Figure 3:
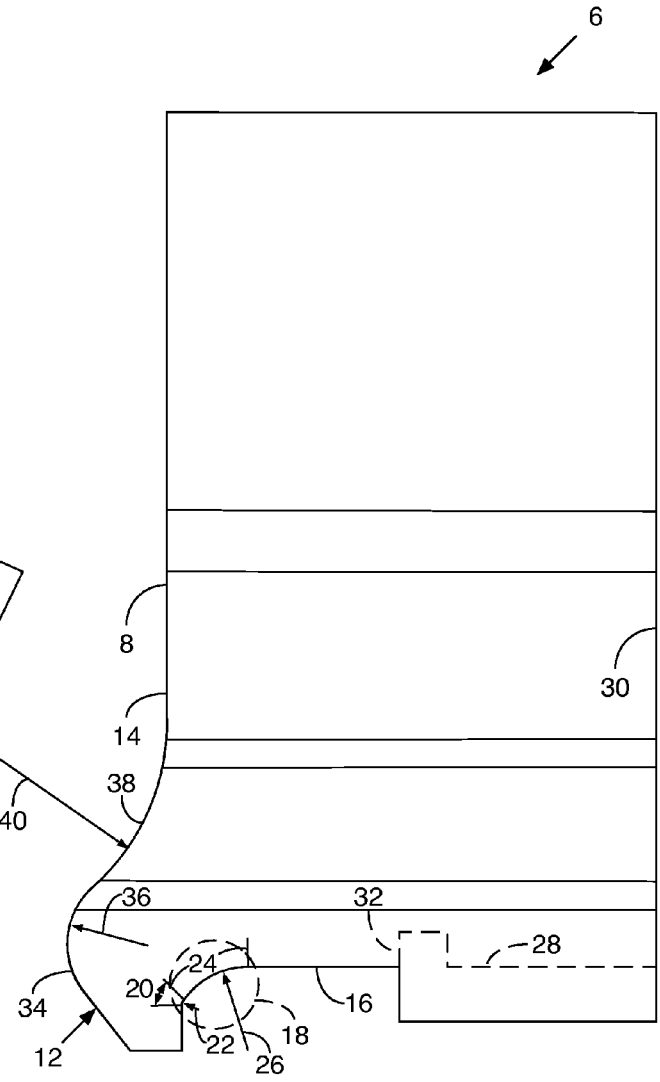
Figure 4:
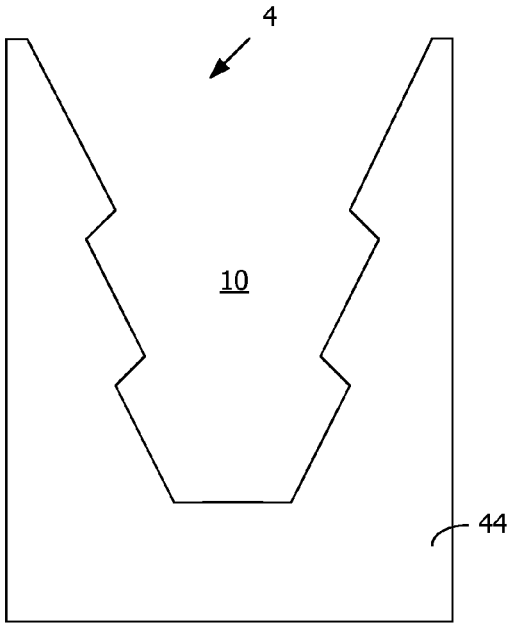
FIGS. 4 and 5 are partial end and side views of a turbine disc for the turbine wheel of FIG. 1.
Figure 5:
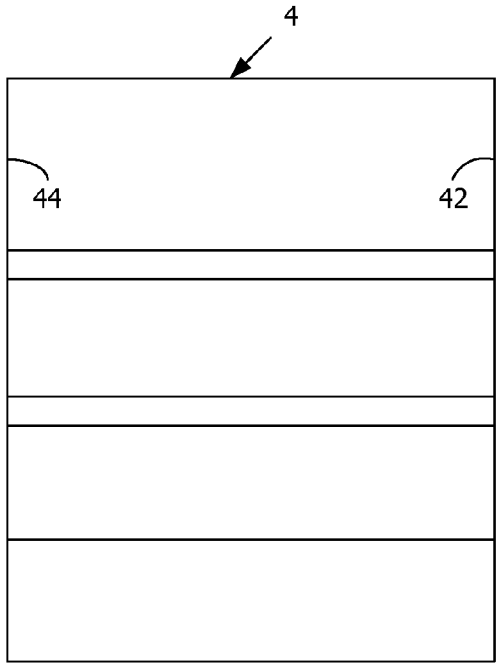
Figure 6:
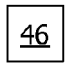
FIGS. 6 and 7 are end and side views of a blade retainer clip for the turbine wheel of FIG. 1 according to a possible embodiment.
Figure 7:
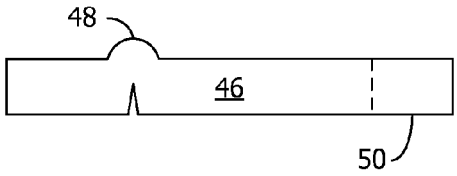
Figure 9:
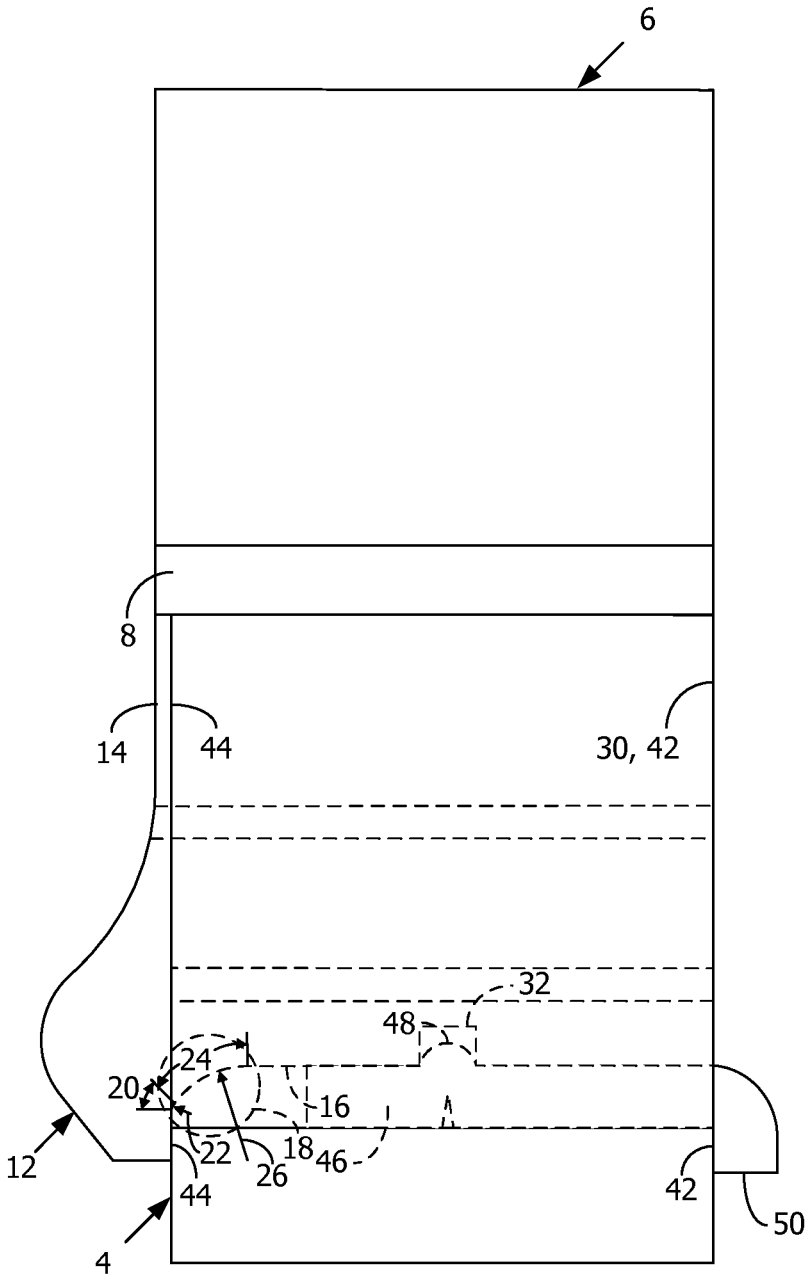

FIG. 9 is a side view of the turbine blade of FIGS. 2 and 3 with the blade retainer clip of FIGS. 6 and 7 inserted into the turbine disc of FIGS. 4 and 5.

Figure 1:
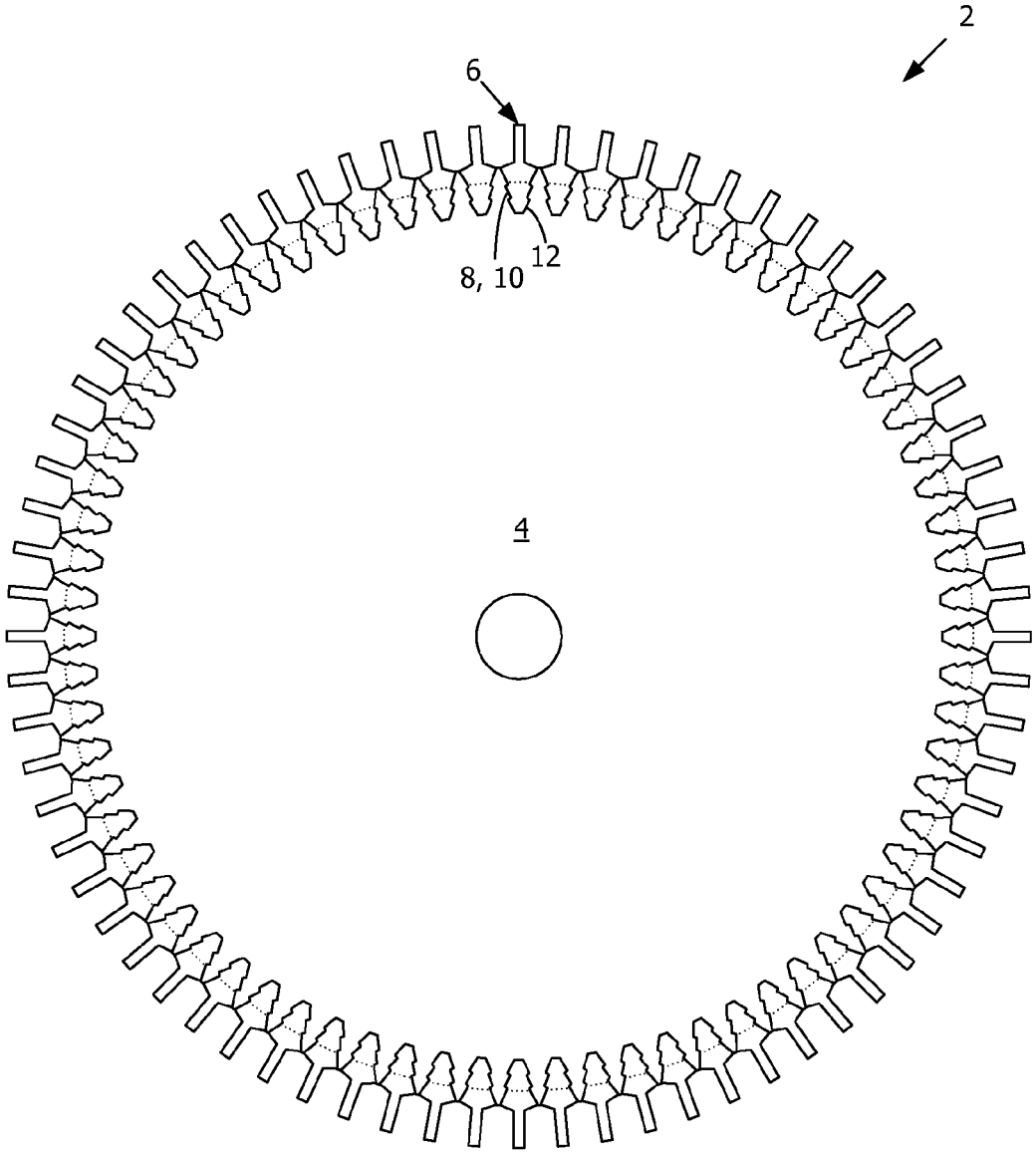
FIG. 1 is an end view of a turbine wheel that may incorporate at least one possible embodiment.
Figure 8:
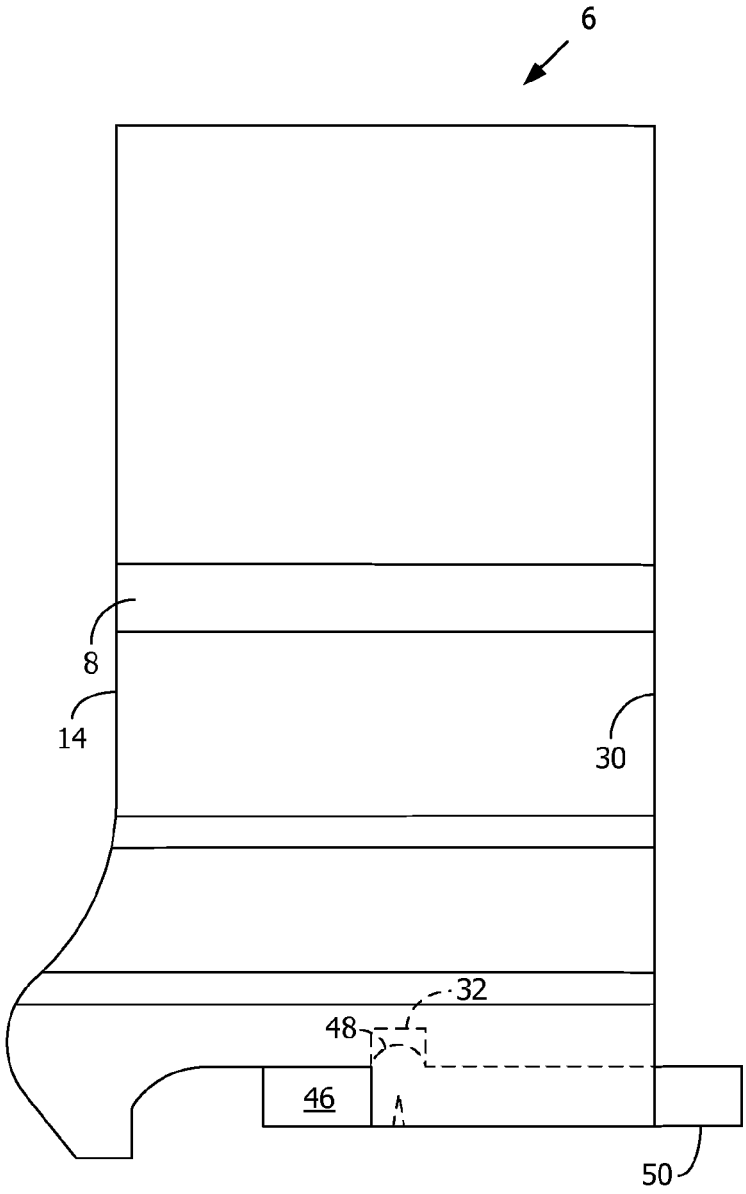
FIG. 8 is a side view of the turbine blade of FIGS. 2 and 3 with the blade retainer clip of FIGS. 6 and 7.

FIG. 1 is an end view of a turbine wheel that may incorporate at least one possible embodiment. FIGS. 2 and 3 are end and side views of a turbine blade for the turbine wheel of FIG. 1. FIGS. 4 and 5 are partial end and side views of a turbine disc for the turbine wheel of FIG. 1. FIGS. 6 and 7 are end and side views of a blade retainer clip for the turbine wheel of FIG. 1 according to a possible embodiment. FIG. 8 is a side view of the turbine blade of FIGS. 2 and 3 with the blade retainer clip of FIGS. 6 and 7. FIG. 9 is a side view of the turbine blade of FIGS. 2 and 3 with the blade retainer clip of FIGS. 6 and 7 inserted into the turbine disc of FIGS. 4 and 5.

Referring to FIGS. 2 and 3 together, the blade retainer hook 12 on a heel end 14 of the foot 8 of the turbine blade 6 protrudes from a bottom 16 of the blade foot 8. A compound fillet 18 engages the hook 12 with the bottom 16 of the blade foot 8. The compound fillet 18 may comprise two fillets, such as a first fillet 20 of relatively small concave radius proximate a hook 12 side of the compound fillet 18, with the magnitude and position of its radius indicated by a first fillet radius 22, and a second fillet 24 of relatively large concave radius of curvature, with the magnitude and position of its radius indicated by a second fillet radius 26. As shown in FIG. 3, the radius 26 intersects the bottom 16 of the blade foot 8 with its tangent coincident with the bottom 16 of the blade foot 8.

The bottom 16 of the blade foot 8 may have a channel or slot 28 that extends from a toe end 30 of the blade foot 8 to a point intermediate the toe end 30 of the blade foot 8 and the heel end 14 of the blade foot 8. The end of the slot 28 intermediate the toe end 30 of the blade foot 8 and the heel end 14 of the blade foot 8 may have a cavity or recess 32.

The side of the hook 12 along the heel end 14 of the blade foot 8 may be curvilinear, such as with a convex hook surface 34, as indicated in magnitude and position by a convex radius of curvature 36, and a concave hook surface 38, as indicated in magnitude and position by a concave radius of curvature 40.

Referring to FIGS. 4 and 5 together, each shoe 10 of the turbine disc 4 has a toe end 42 and a heel end 44. Upon assembly, the heel end 44 of the turbine shoe 10 receives the toe end 30 of its mating blade foot 8.

Referring to FIGS. 6 through 8 together, a blade retainer clip 46 fits into the mating turbine blade foot slot 28. It may include a protuberance 48 that fits into the mating recess 32 of the turbine blade foot mating slot 28. It also includes a deformable clip toe 50. The deformable clip toe 50 extends beyond the turbine blade foot toe end 30. Referring to FIG. 9, the turbine blade foot toe end 30 of the turbine blade foot 8 and the blade retainer clip toe 34 together slip into the turbine disc heel end 44 of the mating turbine disc shoe 10 until the turbine blade foot toe end 30 is flush with the turbine disc shoe toe end 42, which engages the blade retainer hook 12 with the turbine disc shoe heel end 44 of the turbine disc shoe 10. Bending the clip toe 50 over to engage the turbine disc shoe toe end 42 of the turbine disc shoe 10 then locks the turbine blade 6 securely in the turbine disc 4. Since the blade retainer hook 12 engages the turbine blade foot heel end 44, it is not possible for the turbine blade foot 8 to "walk" in its turbine disc shoe 10 toward the turbine disc shoe toe end 42 under load.

Referring to FIGS. 3 and 9 together, the application of the compound fillet 18 between the blade hook 12 and the blade foot bottom 16 distributes stress concentration along the region between the hook 12 and the blade foot bottom 16 due to force that the blade foot 8 applies to the hook 12 against the heel end 44 of the turbine disc shoe 10. More specifically, the magnitude and position of the radius of the first fillet 20, as indicated by the first fillet radius 22, and the magnitude and position of the radius of the second fillet 24, as indicated by the second fillet radius 26, may have values that distribute such stress concentration relatively evenly along the compound fillet 18, thereby increasing resistance to breakage of the hook 12 from the blade foot 8 under extreme loading conditions. Determination of optimised values for the magnitudes and positions for the first fillet radius 22 and the second fillet radius 26 are possible using known methods of analysis, such as by finite element analysis.

The described embodiment as set forth herein represents only an illustrative implementation of the invention as set forth in the attached claims. Changes and substitutions of various details and arrangement thereof are within the scope of the claimed invention.

The invention claimed is:

1. A blade retention system for retaining a foot of a turbine blade in a shoe of a turbine disc of a turbine wheel that comprises:

a hook on a heel end of the blade foot that protrudes from a bottom of the blade foot that engages a heel end of the turbine disc shoe; and a compound fillet that engages the hook with the bottom of the blade foot, the compound fillet including a radius that intersects the bottom of the blade foot with a tangent that is coincident with the bottom of the blade foot.

2. The blade retention system of claim 1, wherein the compound fillet comprises two fillets.

3. The blade retention system of claim 2, wherein the compound fillet comprises a first fillet of relatively small concave radius of curvature proximate a hook side of the compound fillet and a second fillet of relatively large concave radius of curvature proximate a blade foot bottom side of the compound fillet.

4. The blade retention system of claim 3, wherein the magnitude and placement of the radius of curvature of each fillet evenly distribute stress concentration along the compound fillet due to force of the blade foot applied to the hook.

5. The blade retention system of claim 1, wherein a heel side of the hook has a convex radius of curvature extending proximate a bottom of the hook to a concave radius of curvature extending proximate a top of the hook.

6. The blade retention system of claim 1, further comprising:

a slot along a portion of the bottom of the blade foot that extends from a toe end of the blade foot to a point at least intermediate the toe end of the blade foot and the heel end of the blade foot; and a blade retainer clip with a clip shank that fits into the slot of the blade foot and a clip toe that extends beyond a toe of the disc shoe that engages at least the toe of the disc shoe.

7. A blade retention system for retaining a foot of a turbine blade in a shoe of a turbine disc of a turbine wheel that comprises:

a hook on a heel end of the blade foot that protrudes from a bottom of the blade foot to engage a heel end of the turbine disc shoe; and a compound fillet that engages the hook with the bottom of the blade foot, the compound fillet comprising a first fillet of relatively small concave radius of curvature proximate a hook side of the compound fillet and a second fillet of relatively large concave radius of curvature proximate a blade foot bottom side of the compound fillet that intersects the bottom of the blade foot with a tangent that is coincident with the bottom of the blade foot and the magnitude and placement of the radius of curvature of each fillet evenly distribute stress concentration along the compound fillet due to force of the blade foot applied to the hook.

8. The blade retention system of claim 7, wherein a heel side of the hook has a convex radius of curvature extending proximate a bottom of the hook to a concave radius of curvature extending proximate a top of the hook.

9. The blade retention system of claim 7, further comprising a slot along a portion of the bottom of the blade foot that extends from a toe end of the blade foot to at least a point intermediate the toe end of the blade foot and the heel end of the blade foot; and a blade retainer clip with a clip shank that fits into the slot of the blade foot and a clip toe that extends beyond a toe of the disc shoe that engages at least a toe end of the disc shoe.

10. A method of retaining a foot of a turbine blade mounted in a shoe of a turbine disc of a turbine wheel that comprises the steps of:

mounting a hook on a heel end of the blade foot that protrudes from a bottom of the blade foot to engage a heel end of the turbine disc shoe; and distributing stress concentration evenly along a region between the hook and the bottom of the blade foot that engages the hook due to force of the blade foot applied to the hook against the heel end of the turbine disc shoe by means of a compound fillet that engages the hook with the bottom of the blade foot, the compound fillet including a radius that intersects the bottom of the blade foot with a tangent that is coincident with the bottom of the blade foot.

11. The method of claim 10, wherein the step of distributing stress concentration comprises the step of applying a compound fillet between the hook and the bottom of the blade foot.

12. The method of claim 10, wherein the step of distributing comprises the step of applying a compound fillet with two fillets.

13. The method of claim 10, wherein the step of distributing comprises the step of applying a compound fillet that comprises a first fillet of relatively small concave radius of curvature proximate a hook side of the compound fillet and a second fillet of relatively large concave radius of curvature proximate a blade foot bottom side of the compound fillet.

14. The method of claim 13, further comprising the step of determining the magnitude and position of the radius of curvature for the first and second fillets by finite element analysis.

15. A method of retaining a foot of a turbine blade in a shoe of a turbine disc of a turbine wheel that comprises the steps of:

mounting a hook on a heel end of the blade foot that protrudes from a bottom of the blade foot to engage a heel end of the turbine disc shoe;

applying a compound fillet between the hook and the bottom of the blade foot, the compound fillet including a radius that intersects the bottom of the blade foot with a tangent that is coincident with the bottom of the blade foot, to distribute stress concentration evenly along a region between the hook and the bottom of the blade foot that engages the hook due to force of the blade foot applied to the hook against the heel end of the turbine disc shoe; and engaging a toe end of the blade foot with a toe end of to a toe end of the turbine disc shoe.

16. The method of claim 15, wherein the step of applying a compound fillet comprises applying two fillets.

17. The method of claim 15, wherein the step of applying comprises applying a first fillet of relatively small concave radius of curvature proximate a hook side of the compound fillet and a second fillet of relatively large concave radius of curvature proximate a blade foot bottom side of the compound fillet.

18. The method of claim 17, further comprising the step of determining the magnitude and position of the radius of curvature for the first and second fillets by finite element analysis.

19. The method of claim 15, wherein the step of engaging comprises the steps of:

forming a slot along a portion of the bottom of the blade foot that extends from a toe end of the blade foot to a point at least intermediate the toe end of the blade foot and the heel end of the blade foot; and inserting a blade retainer clip with a clip shank that fits into the slot of the blade foot and a clip toe that extends beyond the toe of the disc shoe that engages at least the toe of the disc shoe.

* * * * *